US009784524B1

(12) United States Patent
Ma et al.

(10) Patent No.: US 9,784,524 B1
(45) Date of Patent: Oct. 10, 2017

(54) TOY GUN

(71) Applicant: Alex Brands Buzz Bee Toys (HK) Limited, Kowloon (HK)

(72) Inventors: Chor-Ming Ma, Kowloon (HK); Brownie Johnson, Mt. Laurel, NJ (US)

(73) Assignee: ALEX BRANDS BUZZ BEE TOYS (HK) LIMITED, Kowloon (HK)

( * ) Notice: Subject to any disclaimer, the term of this patent is extended or adjusted under 35 U.S.C. 154(b) by 0 days.

(21) Appl. No.: 15/252,421

(22) Filed: Aug. 31, 2016

(30) Foreign Application Priority Data

Aug. 19, 2016 (HK) ..... 16109944

(51) Int. Cl.

| | |
|---|---|
| ***F41B 11/00*** | (2013.01) |
| ***F41B 7/00*** | (2006.01) |
| ***F41B 7/08*** | (2006.01) |
| ***F41B 11/55*** | (2013.01) |
| ***F41B 11/51*** | (2013.01) |

(52) U.S. Cl.
CPC ..... *F41B 7/006* (2013.01); *F41B 7/003* (2013.01); *F41B 7/08* (2013.01); *F41B 11/51* (2013.01); *F41B 11/55* (2013.01)

(58) Field of Classification Search
CPC ..... F41B 11/00; F41B 11/51; F41B 11/55
See application file for complete search history.

(56) References Cited

U.S. PATENT DOCUMENTS

| | | | | | |
|---|---|---|---|---|---|
| 403,432 | A * | 5/1889 | Knapp | F41B 7/006 | 124/27 |
| 429,106 | A * | 5/1890 | Emlaw | F41B 11/52 | 124/45 |
| 2,101,762 | A * | 12/1937 | Straub | F41B 11/62 | 124/53 |
| 2,631,578 | A * | 3/1953 | Laughlin | F41B 7/006 | 124/27 |
| 3,373,520 | A * | 3/1968 | Into | F41A 9/64 | 124/45 |
| 5,666,937 | A * | 9/1997 | Mendoza-Orozco | F42B 6/10 | 124/51.1 |
| 2007/0256676 | A1* | 11/2007 | Orvis | F41B 11/50 | 124/31 |

* cited by examiner

*Primary Examiner* — John Ricci

(57) ABSTRACT

The invention relates to a magazine for receiving and accommodating one or more projectiles in a toy gun. The magazine comprises a housing defining a chamber adapted to accommodate the one or more projectiles in a longitudinal, inline arrangement; a first positioning member arranged at the chamber and being movable relative to the housing; wherein the first positioning member comprises one or more first engaging means adapted to engage the one or more projectiles, such that the one or more projectiles are permitted to move longitudinally along the chamber in one direction only in response to a projectile advancing or loading movement of the first positioning member. The invention also relates to a toy gun having the magazine as described.

20 Claims, 10 Drawing Sheets

50
60
34
32
30
P2
P1
82
52
62
56
54
58
72
74
70
40
96
(1)
A
B
80
84

50
34
60
32
30
P2
82
P1
85
62
58
56
72
52
70
54
40
74
96
(i)
A
B
88
80
86
84

50
60
P2
82
P1
85
62
56
58
52
72
76
70
40
74
84
A
86
88
(I)

50
60
P2
P1

62
56
52
72
76
58
40
96
(ii)
(i)
84

TOY GUN

FIELD OF THE INVENTION

The invention relates to a toy and, particularly, but not exclusively, to a projectile launching toy such as a toy gun.

BACKGROUND OF THE INVENTION

A variety of projectile firing toys such as, but are not limited to, toy guns of various types are available in the market. Particularly, toy guns have been designed with both decorative and functional features in order to mimic the appearance, operation as well as a user's experience of real guns. For example, breech loading toy guns and pump action toy guns have been developed to simulate the action required by a hand loading firearm. Various features have also been incorporated into traditional toy guns aiming to enhance the user's experience.

OBJECTS OF THE INVENTION

An object of the present invention is to provide a toy gun with an improved projectiles loading feature.

Another object of the present invention is to provide a novel magazine for receiving and accommodating projectiles in a toy gun.

A further object of the present invention is to mitigate or obviate to some degree one or more problems associated with known projectile emitting toys, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a magazine for receiving and accommodating one or more projectiles in a toy gun. The magazine comprises a housing defining a chamber adapted to accommodate the one or more projectiles in a longitudinal, inline arrangement; a first positioning member arranged at the chamber and being movable relative to the housing; wherein the first positioning member comprises one or more first engaging means adapted to engage the one or more projectiles, such that the one or more projectiles are permitted to move longitudinally along the chamber in one direction only in response to a projectile advancing movement of the first positioning member.

In a second main aspect, the invention provides a toy gun having the magazine for receiving and accommodating one or more projectiles according to the first aspect. The toy gun comprises a loading handle mounted with the first positioning member and movable between a first position and a second position; wherein the loading handle is operable such that, when the loading handle is moved from the first position to the second position, a first projectile at a first projectile position of the chamber is transferred to a predetermined position of the toy gun; and subsequently, when the loading handle is moved from the second position to the first position, one or more inline projectiles succeeding the first projectile are arranged to move longitudinally along the chamber in one direction only to thereby fill the first projectile position with a subsequent, second projectile.

In a third main aspect, the invention provides a method of manufacturing a magazine for receiving and accommodating one or more projectiles of a toy gun according to the first aspect. The method comprises the steps of providing a housing which defines a chamber adapted to accommodate the one or more projectiles in a longitudinal, inline arrangement; arranging a first positioning member at the chamber, the first positioning member being movably arranged relative to the housing; providing the first positioning member with one or more first engaging means adapted to engage the one or more projectiles, such that the one or more projectiles are permitted to move longitudinally along the chamber in one direction only in response to a projectile advancing movement of the first positioning member.

In a fourth main aspect, the invention provides a method of manufacturing a toy gun part. The method comprises the steps of providing a magazine for receiving and accommodating one or more projectiles according to the first aspect; arranging a loading handle to be mounted with the first positioning member of the magazine and to be movable between a first position and a second position; wherein the loading handle is operable such that, when the loading handle is moved from the first position to the second position, a first projectile at a first projectile position of the chamber is arranged to be transferred to a predetermined position of the toy gun; and when the loading handle is moved from the second position to the first position, one or more inline projectiles succeeding the first projectile are arranged to move longitudinally along the chamber in one direction only to thereby fill the first projectile position with a subsequent, second projectile.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
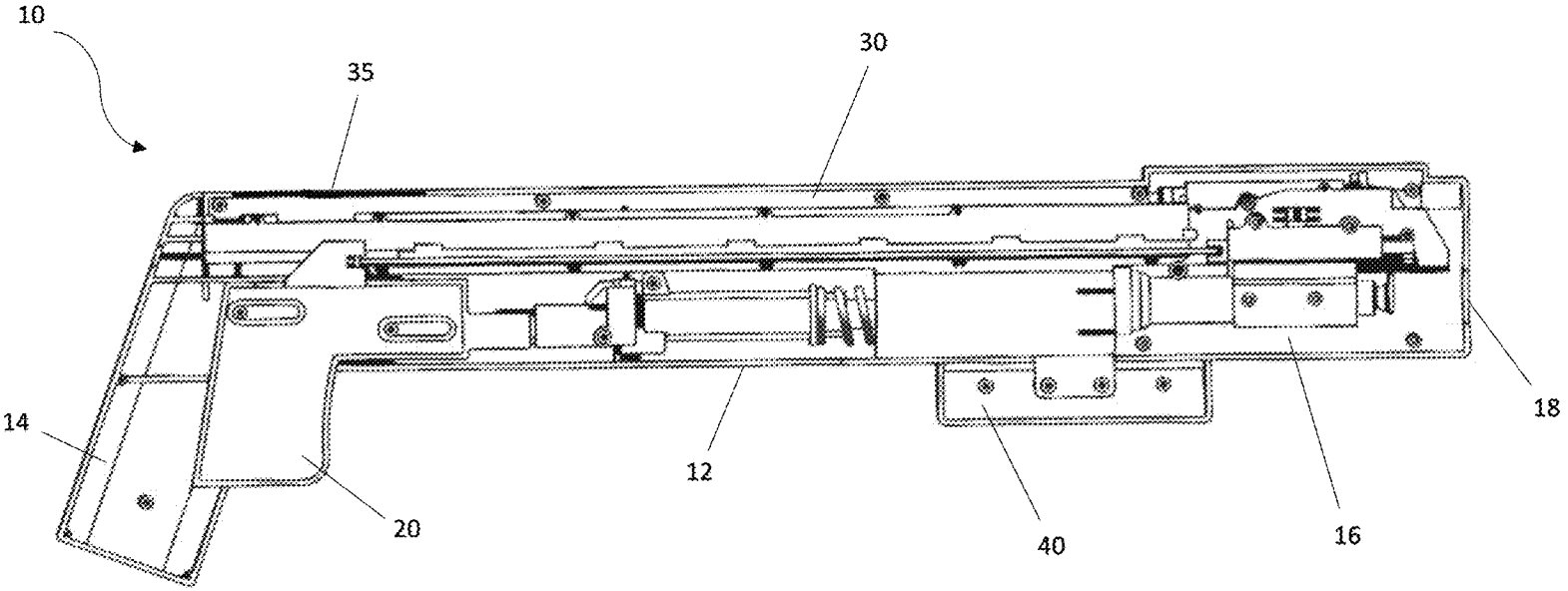
FIG. 1 is a side, internal view of a toy gun according to an embodiment of the present invention.

Referring to FIG. 1, shown is a projectile firing toy in the form of a toy gun 10 according to an embodiment of the present invention. The toy gun 10 is generally configured with a gun body 12 having a hand grip 14, a barrel 16, a muzzle 18 arranged at the end of the barrel 16, and a trigger 20 for triggering launching of a projectile from the barrel 16. The toy gun 10 comprises a magazine 30 for receiving one or more projectiles, darts or bullets via an opening 35, and accommodating the received one or more projectiles in the toy gun 10. The toy gun 10 further comprises a loading handle or grip 40 which is movable in, for example, a back and forth motion between a first position P1 and a second position P2 as shown, for example, in FIG. 3 to thereby arrange, position, manipulate and/or load the one or more projectiles in the toy gun 10.

Figure 2:
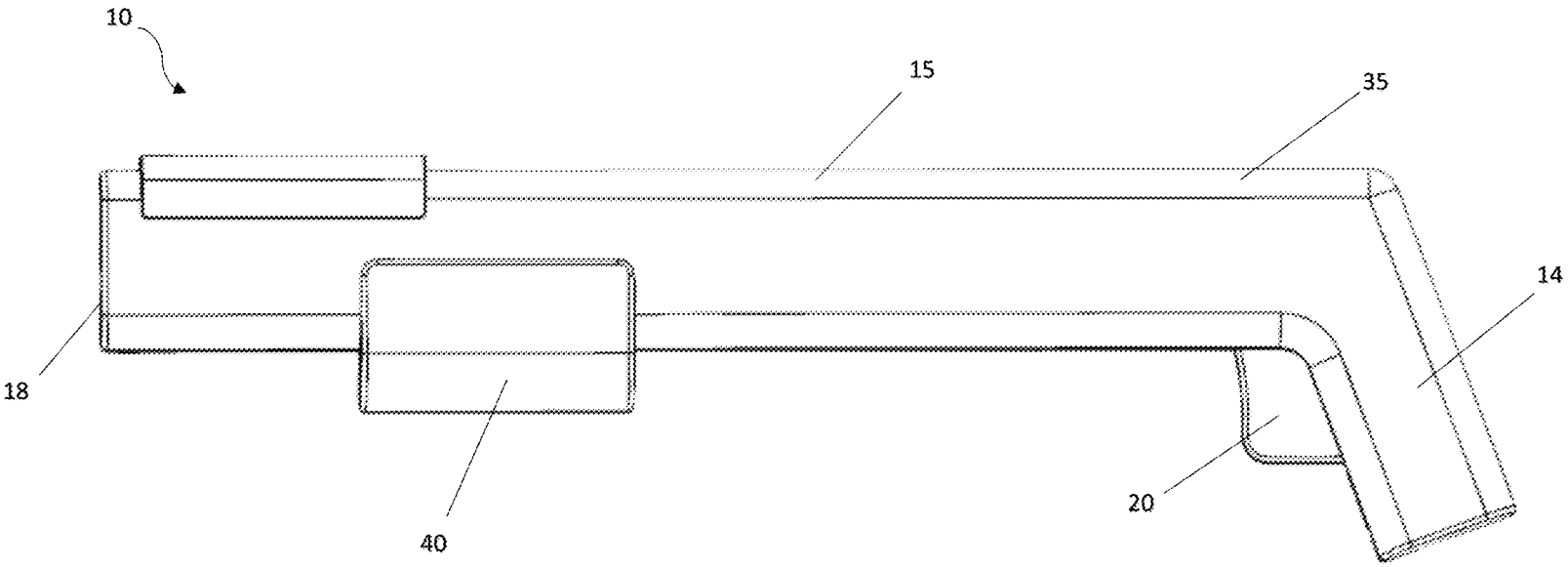
FIG. 2 is a side view showing a casing of the toy gun of FIG. 1.

FIG. 2 shows a casing 15 adapted to operatively encase the internal structures of the toy gun 10 as shown in FIG. 1.

Referring to FIGS. 3 to 7, shown are the mechanisms and the steps involved in one loading cycle of the toy gun 10, during which one or more projectiles are arranged, positioned, manipulated and/or loaded in the toy gun 10 in response to movement of the loading handle 40. In each of the respective figures of FIGS. 3 to 7, the upper and the lower drawings designated by the A and B, respectively, represent two partial, internal views of the same embodiment illustrating different parts of the toy gun 10 at the same operating step. For example, FIG. 3A and FIG. 3B reveal different internal parts of the toy gun 10 when the loading handle 40 is at the first, foremost position P1; FIG. 4A and FIG. 4B show the corresponding internal parts of the toy gun 10 when the loading handle 40 is moving or retracting from the first position P1 to the second, rearmost position P2; FIG. 5A and FIG. 5B show the corresponding internal parts of the toy gun 10 when the loading handle 40 arrives at the second position P2; FIG. 6A and FIG. 6B show the corresponding internal parts of the toy gun 10 when the loading handle 40 is moving from the second position P2 towards the first position P1; and FIG. 7A and FIG. 7B show the corresponding internal parts of the toy gun 10 when the loading handle 40 is returned to the first position P1. In this embodiment, one loading cycle of the toy gun 10 comprises a series of two-stroke actions, such as, a backward action followed by a forward action, although a person skilled in the art would appreciate that a reversed action, i.e. a forward movement from P2 to P1 followed by a backward movement from P1 to P2 of the loading handle 40, should also be encompassed by the present invention.

Specifically, the magazine 30 of the toy gun 10 comprises a housing 32 defining a chamber 34 adapted to accommodate at least one, but preferably a plurality of projectiles in a longitudinal, inline arrangement, for example, as shown in FIG. 3B to FIG. 7B. The expression of "inline arrangement" as used herein refers to the arrangement of the projectiles, darts or bullets substantially in a line, but a person skilled in the art would appreciate that the arrangement of two or more lines of projectiles, darts or bullets in parallel should also be encompassed by the present invention. The skilled person would also appreciate that, although the magazine 30 as illustrated in the specific embodiment in the figures is positioned at an upper portion of the toy gun 10 and, more specifically, substantially above the barrel 16 of the toy gun 10, variation in the location of the magazine 30 such as, for the magazine 30 to be arranged at the side of and parallel to the barrel 16 of the toy gun, should also be encompassed by the present invention.

The magazine 30 comprises a first positioning member 50 arranged at the chamber 34 and being movable relative to the housing 32. The first positioning member 50 is mounted with the loading handle 40 of the toy gun 10, with the loading handle 40 being movable between the first position P1 and the second position P2. Specifically, the first positioning member 50 comprises one or more first engaging means 52 adapted to engage the one or more projectiles, such that the one or more projectiles are permitted to move longitudinally along the chamber 34 in one direction only in response to a projectile advancing movement or a loading movement of the first positioning member 50 caused by the corresponding movement of the loading handle 40. Preferably, the one or more first engaging means 52 adapted to engage and to manipulate the one or more projectiles to advance longitudinally along the chamber 34 in a forward direction only towards a projectile loading position A of the toy gun 10, as shown in the figures. More preferably, the one or more projectiles comprises a plurality of projectiles, with each of the plurality of inline projectiles being arranged to advance one position towards the projectile loading position A in response to each projectile advancing or loading movement of the first positioning member 50. The term "projectile loading position" as used herein refers to a position at the chamber 34, usually the foremost position at the chamber 34 occupied by a first projectile of the plurality of inline projectiles, at which the first projectile is engageable by a projectile transferring mechanism 80 for transferring the first projectile from the projectile loading position A to a predetermined, firing position B for launching. In the context of this description, the "projectile loading position" can be understood as being equivalent to the "first projectile position" as later described in the following description.

As shown in the figures, the first positioning member 50 can be slidably mounted in the housing 32, and may comprise a plurality of first engaging means 52 aligned longitudinally at the first positioning member 50 which extends at least partially along the chamber 34 defined by the housing 32. Preferably, each of the first engaging means 52 comprises a first retention member 54, with the first retention member 54 comprising a sliding surface 56 having, for example, an inclined surface adapted to slidably engage a respective projectile during a retraction movement of the first positioning member 50 caused by the backward movement of the loading handle 40 from the first position P1 to the second position P2. In response to said retraction movement, the first retention member 54 is adapted to slide over a surface of its respective projectile without displacing said projectile along the chamber 34, see FIGS. 3 to 5.

More preferably, the first retention member 54 may comprise a surface 58 adapted to abut a part of its respective projectile, for example, a rear end of the respective projectile, such that, in response to the forward movement of the first positioning member 50, the first retention member 54 pushes the respective projectile to advance along the chamber 34 towards the projectile loading position, see FIGS. 6 and 7. The abutting surface 58 of the first retention member 54 also prevents the respective projectile from moving backward, thereby ensuring a uni-directional movement, i.e. a forward movement of the projectiles along the chamber 34.

In one embodiment, the one or more first engaging means 52 can be movably connected, for example, by means of a pivot connection, with the first positioning member 50 as shown in the figures. The pivotal connection allows the first positioning member 50 to pivot away from the respective projectile when the sliding surface 56 of the first retention member 54 slidably engages the surface of the respective projectile, such that backward movement of the first positioning member 50 relative to the housing 32 would not substantially alter position of the projectiles in the chamber 34.

Alternatively, the first engaging means 52 may be arranged to flexibly connect to the first positioning member 50 so that the first engaging means 52 is adapted to flexibly slip over the surface of the respective projectile during a backward movement of the first positioning member 50 without affecting the position of the projectiles in the chamber 34.

The specific configuration of the first retention member 54 and its corresponding engagement with the respective projectile allow a uni-directional movement of the projectile along the chamber 34, i.e. a forward movement of the projectiles along the chamber 34 but not in a reverse direction.

In a another embodiment, the magazine 30 may further comprise a second positioning member 60 arranged at the chamber 34 and being in a fixed position relative to the housing 32. Specifically, the second positioning member 60 may comprise one or more second engaging means 62. When cooperating with the one or more first engaging means 52 of the first positioning member 50, the second engaging means 62 are adapted to engage the one or more projectiles and to permit longitudinal movement of the one or more projectiles along the chamber 34 in one direction only in response to the projectile advancing or loading movement of the first positioning member 50. In the specific embodiment as shown in the figures, the first positioning member 50 is preferred to be arranged at the lower side of the magazine 30 and the second positioning member 60 is preferred to be fixedly mounted at an opposing, upper side of the magazine 30, although the present invention should not be limited to this specific configuration.

The second engaging means 62 can be configured to be substantially identical to the first engaging means 52, as shown in the figures, which assists in simplifying the manufacturing process. Nevertheless, it will be understood that the second engaging means 62 may be provided in other configurations or forms different to that of the first engaging means 52, as long as it is capable of providing the described technical function.

In addition, it will be understood that the first engaging means 52 and the second engaging means 62 may be provided in other configurations or forms, as long as it is capable of providing the described technical function.

In one embodiment, the housing 32 of the magazine 30 comprises an opening 35 via which the one or more projectiles are successively received, either laterally or longitudinally, into the chamber 34, with the chamber 34 being defined between the first positioning member 50 and the second positioning member 60. The opening 35 is preferred to be arranged at or adjacent a rear end of the housing 32.

The two-stroke loading action of the toy gun 10 in response to movement of the loading handle 40 between the first position P1 and the second position P2 in accordance with an embodiment of the present invention is now described in detail as follows.

Although in the embodiments as described below, it is preferred for the loading handle 40 to be manually actuated or manipulated by the user's hand so as to mimic a hand loading action of a firearm, it is apparent that the present invention should not be limited to a hand, manual loading, but to encompass any other possible way of moving the loading handle, such as, for example, an electrically powered movement of the loading handle.

As described, the loading handle 40 is mounted with the first positioning member 50 and is movable between the first position P1 and the second position P2 to thereby simultaneously move the first positioning member 50 back and forth along the chamber 34. Specifically, movement such as a manual movement of the loading handle 40 by the user from P1 to P2 causes the first positioning member 50 to move backwards towards the rear end of the toy gun 10, while movement of the loading handle 40 from P2 to P1 causes the first positioning member 50 to move forwards along the chamber 34 towards the direction of the projectile loading position A near the front end of the toy gun 10.

Figures 3A, 3B:
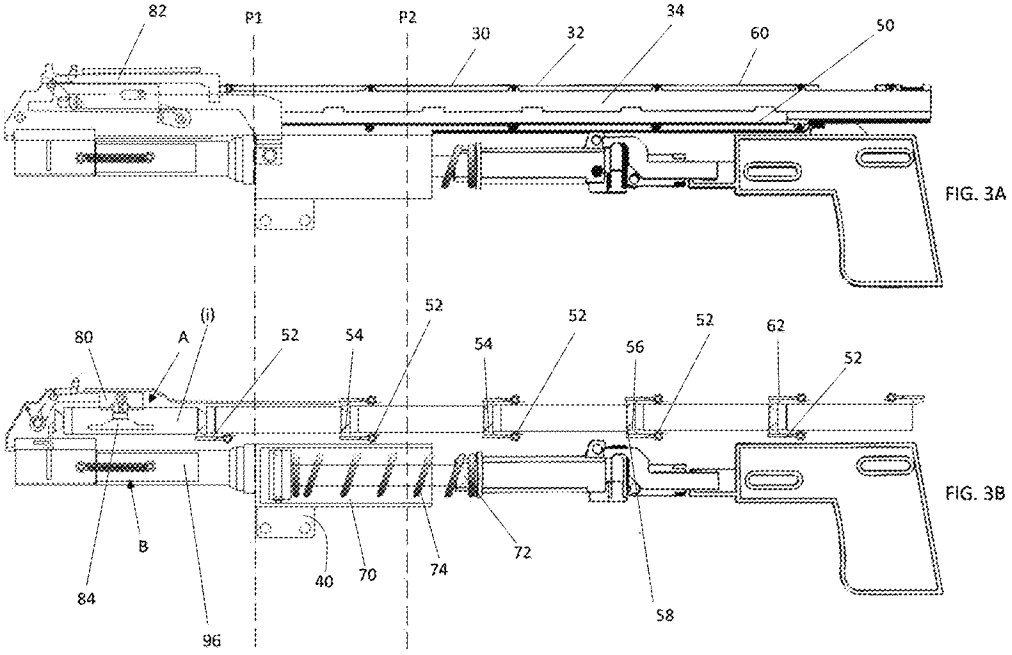
FIGS. 3A and 3B are side, internal views showing the toy gun of FIG. 1 with a loading handle at a first position and a pump spring unloaded.

Step 1: FIG. 3 shows an unloaded state of the toy gun 10 with the loading handle 40 at a standby, first position P1, i.e. there is no projectile loaded yet into the barrel. Specifically, the loading handle 40 is operatively connected with a pumping mechanism 70 which comprises a latch 72 and a resilient member 74. As shown in FIG. 3B, the resilient member 74 is unloaded at the standby position.

The toy gun 10 further comprises a projectile transferring mechanism 80 which engages the first projectile (i) at the first projectile position A of the chamber 34, i.e. equivalent to the projecting loading position A as earlier described. The projectile transferring mechanism 80 is operatively connect with the loading handle 40 via a shaft 82, and is adapted to transfer the first projectile (i) from the first projectile position A to the firing position B for launching the projectile. Preferably, the first projectile position A is arranged near or adjacent the firing position B of the toy gun 10, and that the firing position B is arranged near or adjacent the muzzle 18 at the barrel 16 of the toy gun 10. As shown in FIG. 3B, the firing position B is substantially occupied or blocked by a launching member 96 connected with the loading handle 40 when the loading handle 40 is at the standby, first position P1. The launching member 96 is part of a launching mechanism 90 for launching the projectile from the firing position B, which will then be described in further detail.

The projectile transferring mechanism 80 comprises an arm member 84 for engaging the first projectile (i) at the first projectile position A in the current step, and subsequently, transferring and releasing the first projectile (i) at the firing position B of the toy gun 10. The arm member 84 may further be connected to a pivot via a spring-loaded leverage means 86 for a resilient movement between the first projectile position A and the firing position B. The leverage means 86 may optionally comprise a pusher 88 at one end adapted to push the projectile down to the firing position B. Preferably, the arm member 84 may comprise, for example, a clamp, a grip, or the like for securely holding the first projectile (i) at the first projectile position A at the standby position as shown in FIG. 3B. Structures of the projectile transferring mechanism 80 are further illustrated in FIG. 9, which shows the holding of a projectile by the arm member 84.

Figures 4A, 4B:
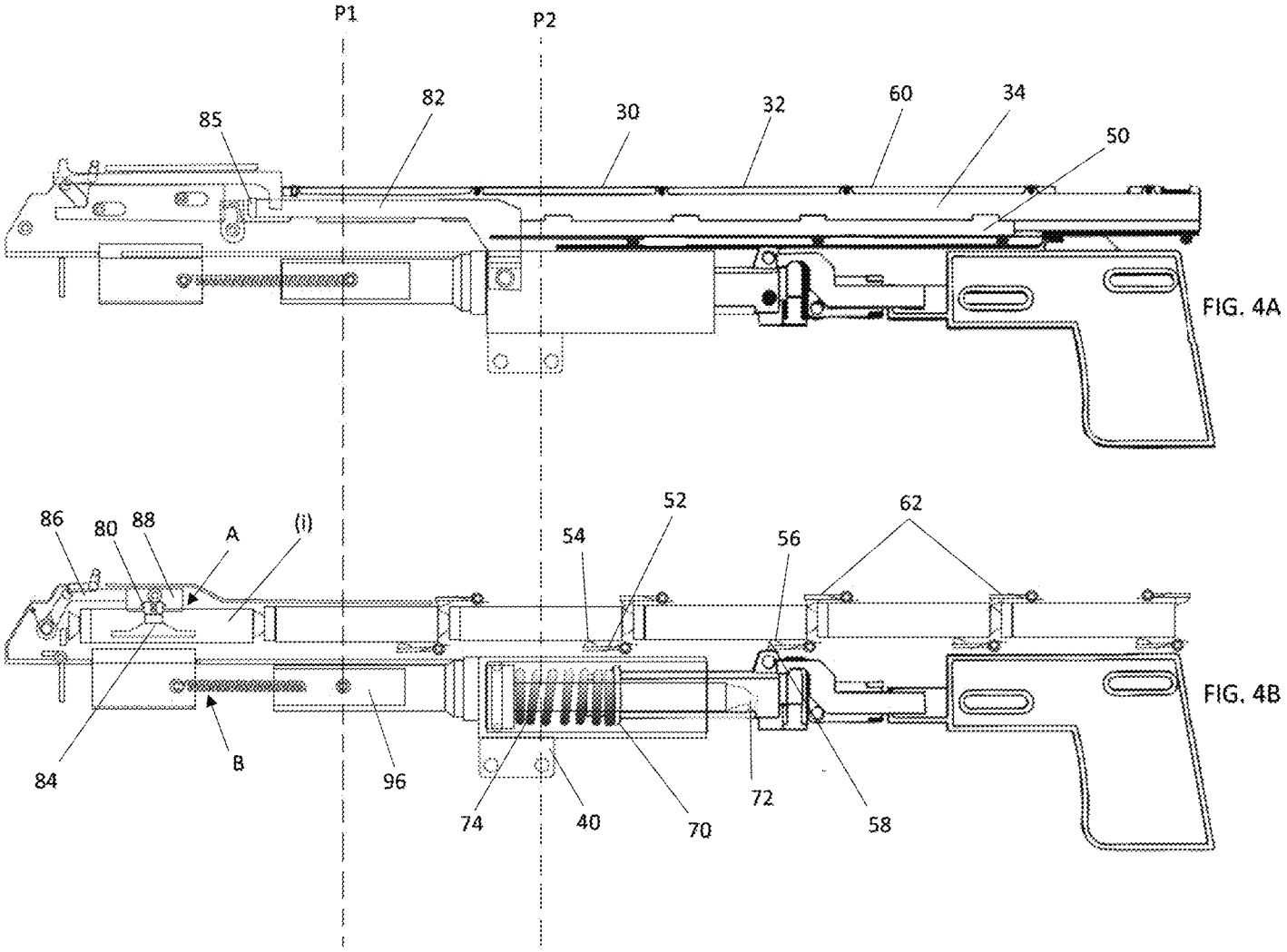
FIGS. 4A and 4B are side, internal views showing the toy gun of FIGS. 3A and 3B with the loading handle moving from the first position to a second position.

Step 2: FIG. 4 shows a loading step of the toy gun 10 when the loading handle 40 is moved from the first position P1 to the second position P2. As shown in FIG. 4B, backward movement of loading handle 40 pushes the latch 72 to move or to slide backward and at the same time, compresses the resilient member 74 to a partially-loaded condition. Movement of the loading handle 40 also allows the launching member 96 to depart from the firing position B to thereby leaving the firing position B vacant, as shown in FIG. 4B. Backward movement of the loading handle 40 further retracts the shaft 82 along the side of the chamber 34 towards the rear end of the toy gun 10, as shown in FIG. 4A. The arm member 84 securely holds the first projectile at the first projectile position A, and will release the first projectile to the firing position B only when the first projectile is pushed downward by the pusher 88 of the leverage means 86 in the next step, as shown in FIG. 5.

In response to the movement of loading handle 40 from P1 to P2, the first positioning member 50 and thus the plurality of first engaging means 52 are arranged to slide backwards along the chamber 34. Due to the slidable engagement of the sliding surfaces 56 of the first retention members 54 with surfaces of the inline projectiles and/or the movable connection of the first engaging means 52 at the first positioning member 50, the first retention members 54 are allowed to slide over the surfaces of their respective projectiles without displacing said projectiles along the chamber 34, see FIG. 4B.

Figures 5A, 5B:
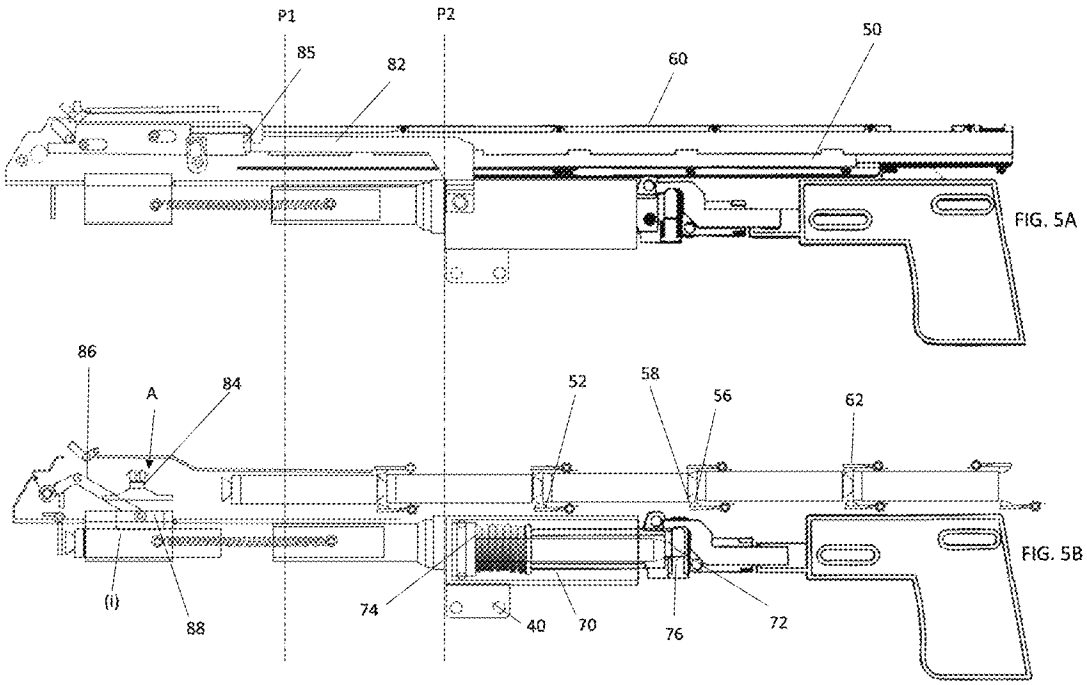
FIGS. 5A and 5B are side, internal views showing the toy gun of FIGS. 4A and 4B with the loading handle at the second position.

Step 3: FIG. 5 shows a loaded position of the toy gun 10 with the loading handle 40 at the second position P2. As shown in FIG. 5B, movement of the loading handle 40 to the second position allows the latch 72 to lock at a corresponding notch or hook 76 and, at the same time, renders the resilient member 74 as being fully compressed and thus loaded. The shaft 82 of the projectile transferring mechanism 80 is also brought to a full retraction by the movement of the loading handle 40, as shown in FIG. 5A, which allows a block member 85 located at a front end of the shaft 82 to actuate the arm member 84 and/or the leverage means 86 of the projectile transferring mechanism 80 to descend from the projectile loading position A and subsequently, to release the first projectile (i) into the firing position B, as shown in FIG. 5B.

The first positioning member 50 is brought to the rearmost position along the chamber 34, with the plurality of first engaging means 52 being positioned such that the corresponding first retention members 54 are adapted to engage a respective part or a respective end of their respective projectiles. Specifically, the abutting surfaces 58 of the first retention members 54 are ready to push the respective projectiles to advance along the chamber 34 by one position when the first positioning member 50 is made to move toward. Positioning of the projectiles are further assisted by the second positioning member 60 located at the upper side of the magazine 30, as shown in FIG. 5B, with the plurality of second engaging means 62 permitting movement of the projectiles in a forward movement only.

Steps 1 to 3 cover the first, rearward stroke of action in loading the toy gun 10.

Figure 6A:
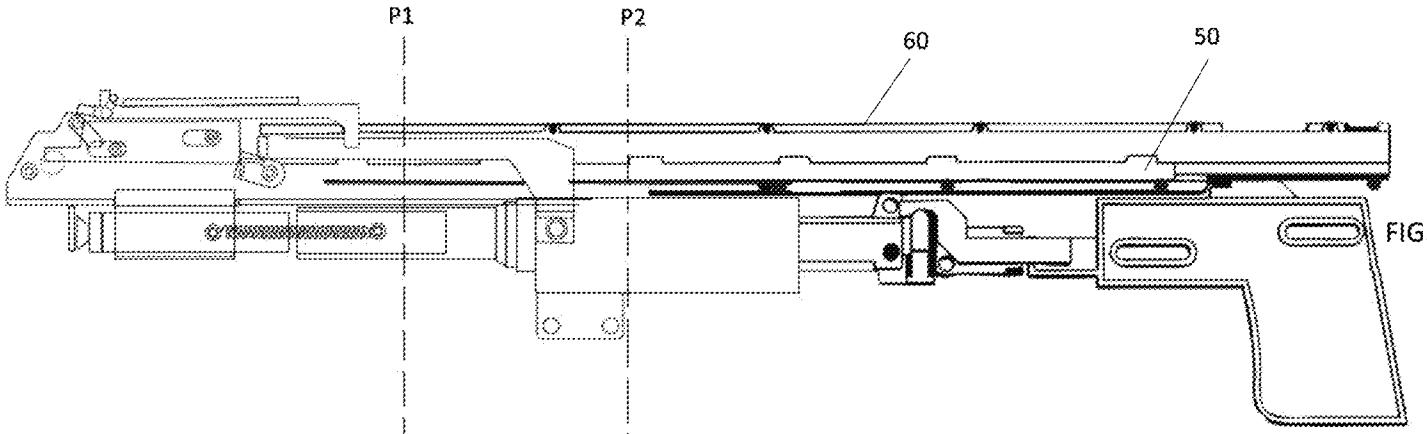
FIGS. 6A and 6B are side, internal views showing the toy gun of FIGS. 5A and 5B with the loading handle moving from the second position to the first position.
Figure 6B:
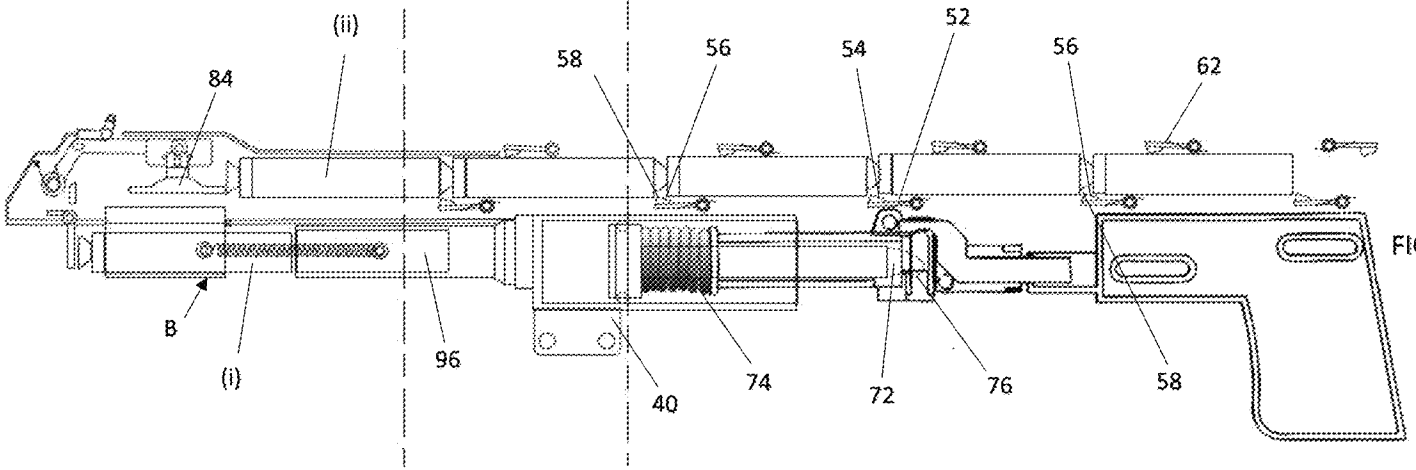

Step 4: FIG. 6 shows the loading step of the toy gun 10 when the loading handle 40 is moved from the second position P2 to the first position P1. As shown in FIG. 6B, forward movement of the loading handle 40 allows the launching member 96 to approach and eventually engage the first projectile (i) at the firing position B, and at the same time, allows the latch 72 to remain locked and thus the resilient member 74 to stay loaded. As shown in the figure, a door or gate 92 arranged near or adjacent the muzzle 18 is kept closed to prevent the loaded projectile (i) from departing from the firing position B and/or slipping off from the muzzle 18. More particularly, the gate 92 prevents the loaded projectile (i) from falling out of the barrel of the gun prior to operation of the trigger in the event that the gun is held in an inclined position with the barrel pointing towards the ground.

In response to the forward movement of the loading handle 40, the first positioning member 50 is brought forward and thus the abutting surfaces 58 of the first retention means 54 push the respective inline projectiles, which succeed the first projectile (i) in the earlier steps 1 and 2, to advance longitudinally by one position along the chamber 34. The forward movement of the inline projectiles allows a subsequent second projectile (ii) to take up the first projectile position A, which was left vacant after the first projectile (i) was transferred to the firing position B by the projectile transferring mechanism 80 in Step 3. The first and the second retention means 54, 64 of the first and the second positioning member 50, 60 cooperatively position the inline projectiles in the chamber 34 to allow only a forward movement of the projectiles, and to prevent any backward movement of the projectiles, within the chamber 34.

Figures 7A, 7B:
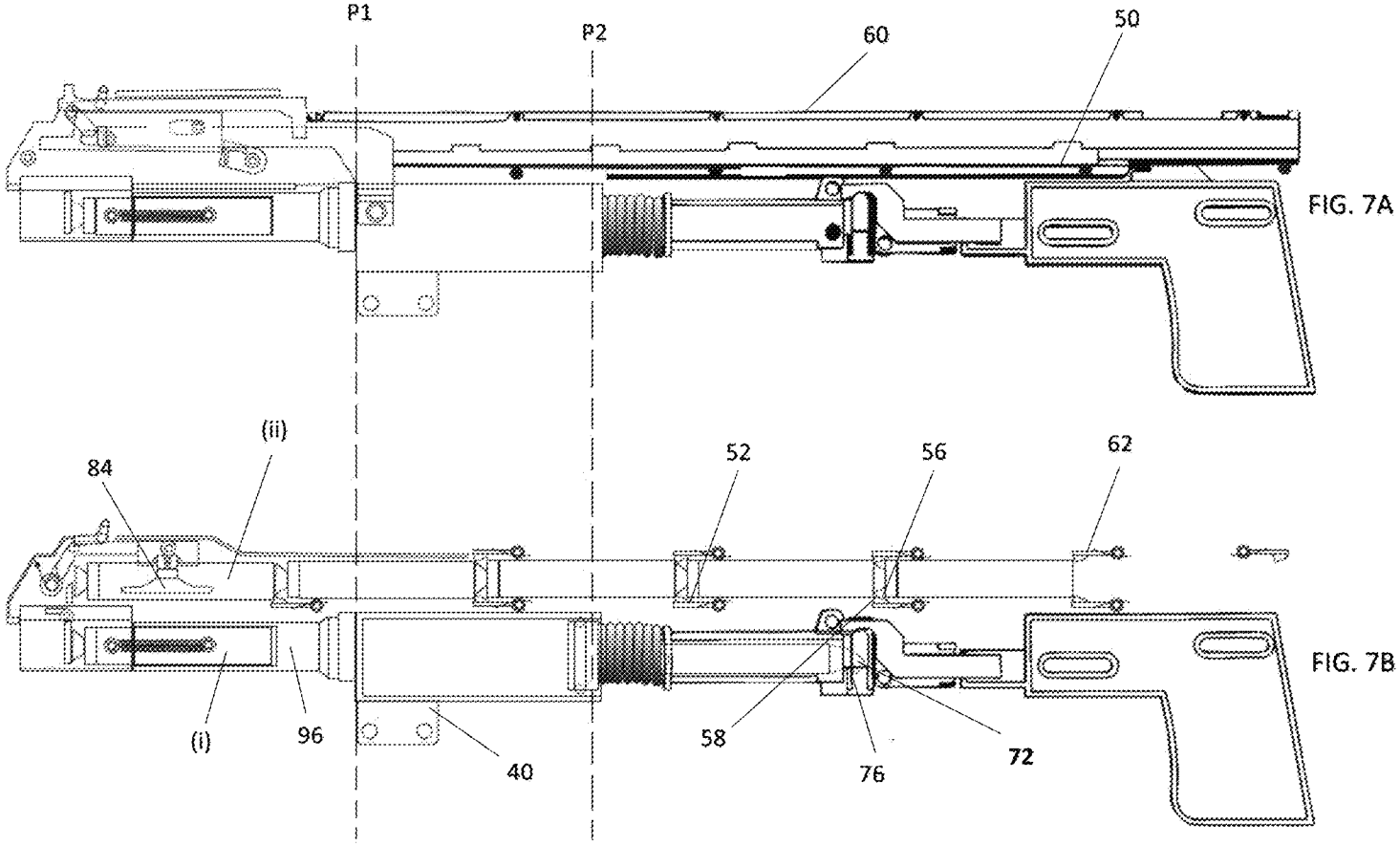
FIGS. 7A and 7B are side, internal views showing the toy gun of FIGS. 6A and 6B with the loading handle at the first position and the pump spring loaded.
Figure 9:
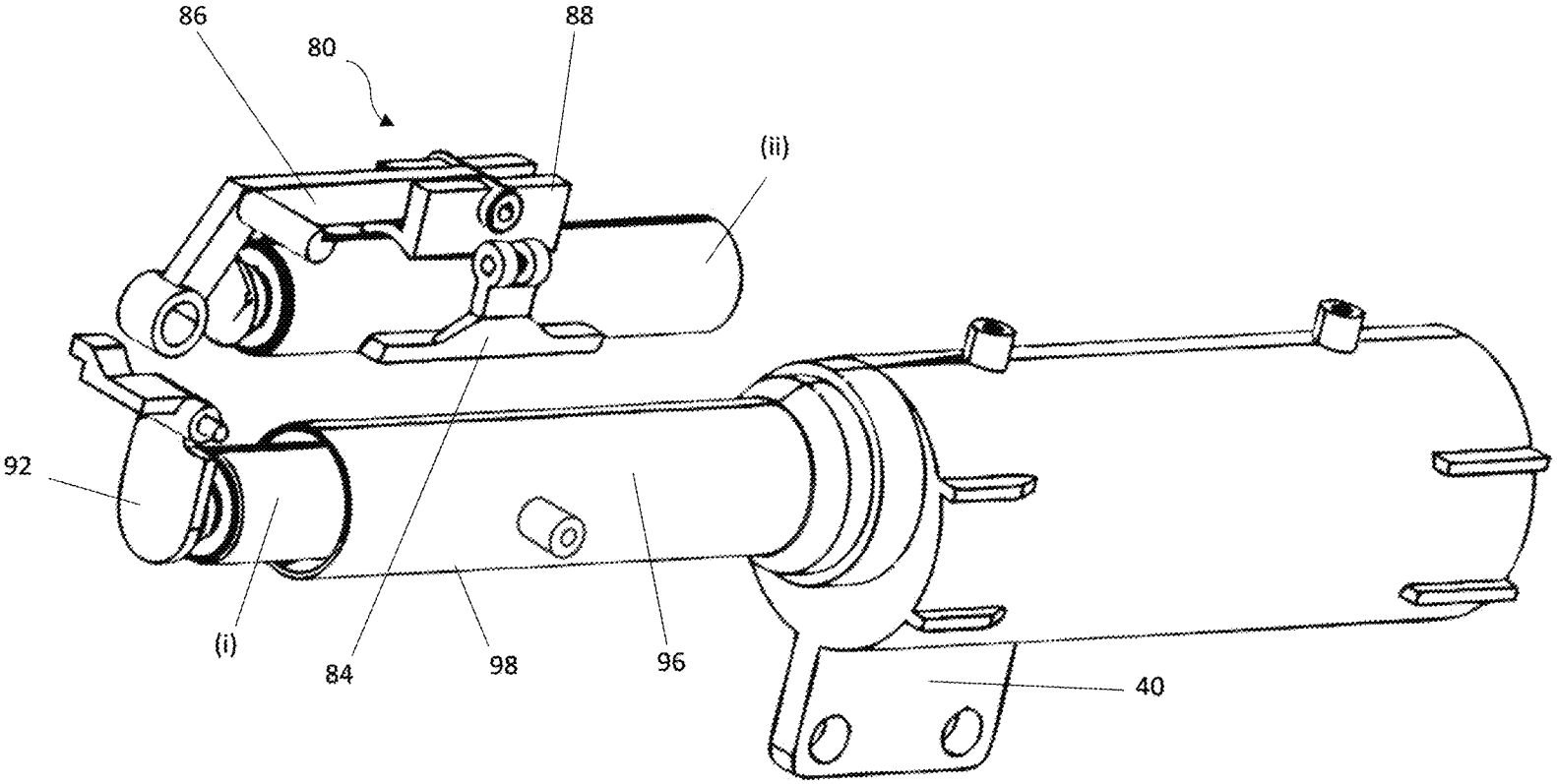
FIG. 9 is a perspective view showing a projectile transferring mechanism of the toy gun of FIG. 1.

Step 5: FIG. 7 shows the loading handle 40 at the first position P1 which completes the two-stroke loading action of the toy gun 10. As shown in FIG. 7B, with the loading handle 40 being brought to the foremost position of P1, the launching member 96 is allowed to engage and position the first projectile (i) at the firing position B while the resilient member 74 is allowed to remain loaded and the latch 72 is allowed to remain locked. In one embodiment which is also shown in FIG. 9, the engaging of the first projectile (i) by the launching member 96 at the firing position B can be achieved by partially receiving the projectile (i) by a cylindrical body 98 of the launching member 96. The inner wall of the cylindrical body 98 may frictionally engage the surface of the first projectile (i) to thereby hold the projectile in place at the firing position B prior to operation of the trigger. The remainder of the projectiles in the magazine 30 are also kept in position by the action of the first and the second engaging means 52, 62. The first projectile (i) is now loaded and is ready to launch once the trigger 20 is actuated by the user.

Figure 8A:
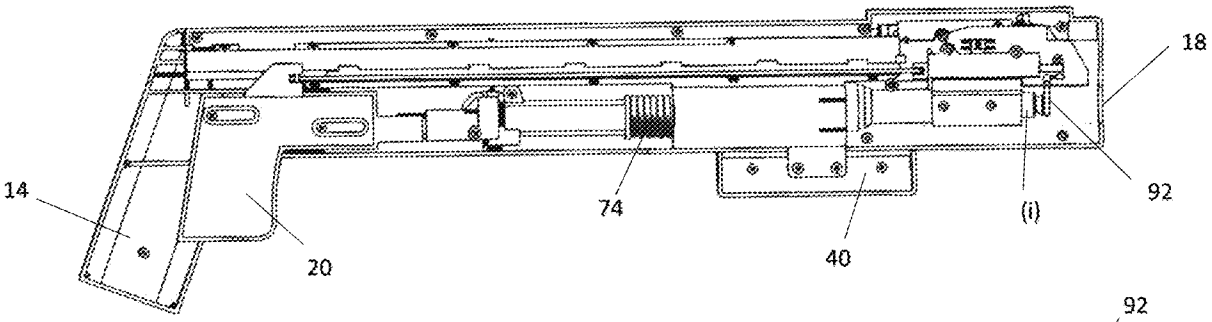
FIGS. 8A, 8B and 8C show the triggering of the release of a projectile from the toy gun of FIG. 7A or 7B.
Figure 8B:
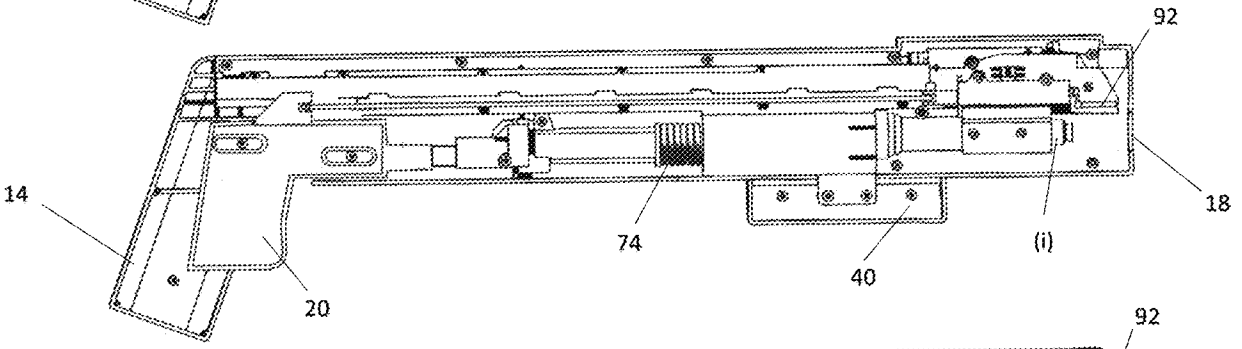
Figure 8C:
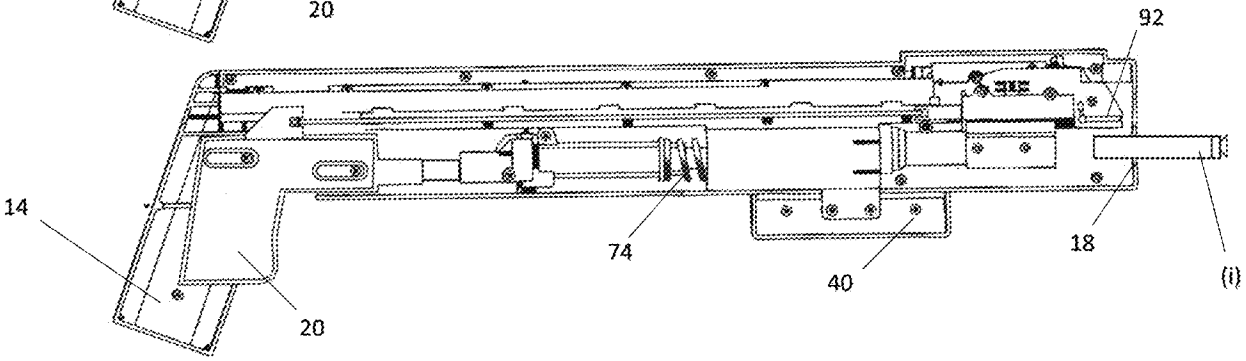

FIG. 8 shows the triggering or launching steps of the toy gun 10 to thereby fire or launch the loaded projectile (i). Specifically, FIG. 8A shows a projectile loaded state of the toy gun 10, which is equivalent to the condition shown in FIG. 7. Launching of the projectile is triggered by pressing on the trigger 20 by the user. In response to the triggering action, the door or gate 92 will be opened (see FIG. 8B) to prepare for the emission of the projectile (i) from the muzzle 18. The triggering action also actuates the launching mechanism 90 which cooperates with the pumping mechanism 70 to release the loaded resilient member 74 and thereby, launch the projectile (i) from the barrel via the muzzle 18 (see FIG. 8C). The launching mechanism 90 may further comprise any known parts and/or components for launching a projectile, such as but not limited to, one or more resilient means such as springs for discharging the projectile via stored potential energy, and/or one or more piston and cylinder arrangements for discharging the projectile via pressurized fluid flow, etc.

Figure 10:
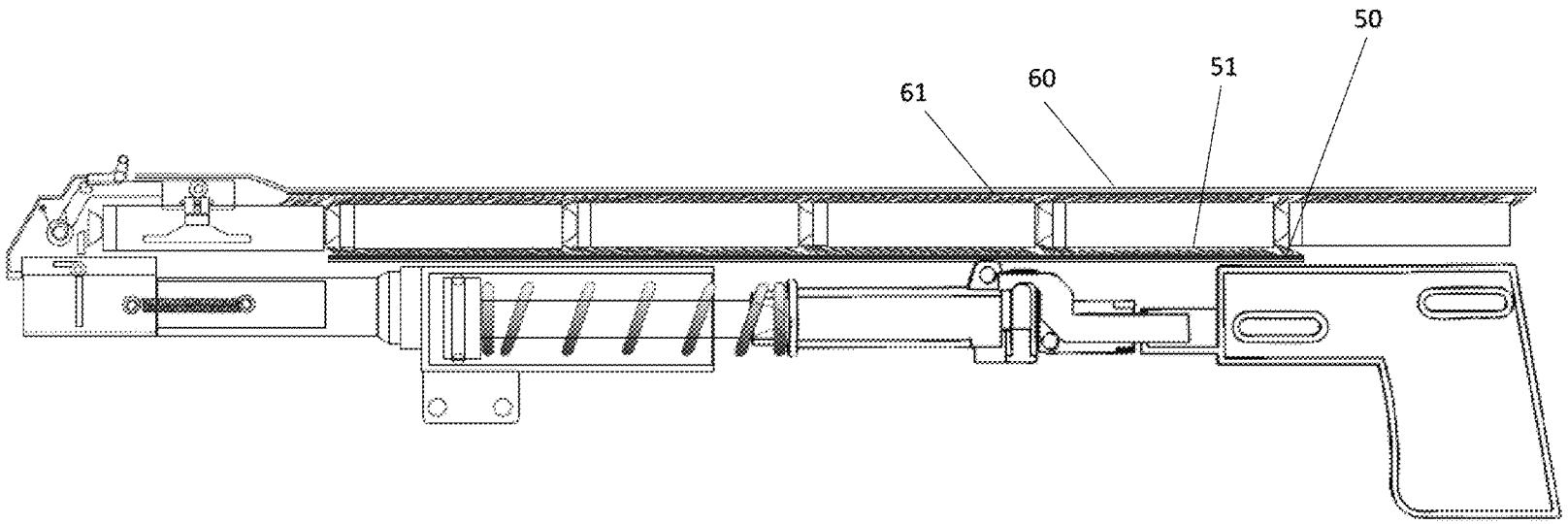
FIG. 10 is a side, internal view of a toy gun according to a further embodiment of the present invention.

In one further embodiment, one or more of the first and the second positioning members 50, 60 can be arranged for the corresponding engaging means 52, 62 to comprise one or more materials such as fabric materials 51, 61, as shown in FIG. 10, which are capable of providing different surface frictions when engaged in different directions by an object. For example, when the fabric material 51 is engaged by the inline projectiles during a backward movement of the first positioning member 50, the fabric material 51 is adapted to impose a relatively lower surface friction against the surfaces of the projectile than one generated during a forward movement of first positioning member 50. Specifically, the frictional force generated at the fabric material 51 during a forward movement of the first positioning member 50 can be sufficiently high, such that the inline projectiles can be pushed forward by the frictional force along with the forward movement of the first positioning member 50, while any backward movement of the first positioning member 50 and thus the fabric material 51 will allow the inline projectiles to stay intact with no displacement along the chamber 34. This arrangement permits only a uni-directional movement of the inline projectiles along the chamber 34, i.e. a forward movement of the projectiles but not in a reverse direction along the chamber 34. The present invention also relates to a method of manufacturing the magazine 30 for receiving and accommodating one or more projectiles of the toy gun 10 as described above. The present invention further relates to a method of manufacturing the toy gun 10 having the magazine 30 as described above.

The present invention is advantageous in that it provides an inline loading mechanism for loading one or more projectiles, darts or bullets into a toy gun. A player or user is allowed to insert the projectiles, one after one, into a chamber of a magazine via an opening. The chamber is provided with one or more engaging means adapted to keep the projectiles in place, and at the same time, to allow movement of the projectiles only in a forward direction. The loading action is achieved by a two-stroke movement of a loading handle of the toy gun, such as but is not limited to, a backward and then forward manual movement of the loading handle by the user, to thereby mimic a two-stroke pumping action of a firearm and to improve the user's experience. During the first stroke loading action by moving the loading handle backward, the first projectile in the magazine will be transferred to the firing position adjacent the muzzle of the barrel. Subsequently, during the second stroke loading action by moving the loading handle forward, the remaining inline projectiles will be advanced along the chamber and for the second projectile to fill up the now vacant first projectile position. At the same time, the first projectile which was transferred to the firing position during the first stroke, will then be engaged by a launching member of the launching mechanism for launching the projectile from the toy gun.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such prior art does not constitute an admission that the prior art forms a part of the common general knowledge in the art.

The invention claimed is:

1. A magazine for receiving and accommodating one or more projectiles in a toy gun, comprising:

a housing defining a chamber adapted to accommodate the one or more projectiles in a longitudinal, inline arrangement;

a first positioning member arranged at the chamber and being movable relative to the housing;

wherein the first positioning member comprises one or more first engaging means, with the one or more first engaging means being movable in a same direction along with movement of the first positioning member; the one or more first engaging means being adapted to engage the one or more projectiles, such that the one or more projectiles are permitted to move longitudinally along the chamber in one direction only in response to a projectile advancing movement of the first positioning member.

2. The magazine according to claim 1, wherein the one or more projectiles comprises a plurality of projectiles, each projectile of the plurality of inline projectiles being arranged to advance one position towards a projectile loading position along the chamber in response to each projectile advancing movement of the first positioning member.

3. The magazine according to claim 2, wherein the first positioning member comprises a plurality of first engaging means, each first engaging means comprising a first retention member, the first retention member comprising a surface adapted to abut a part of a respective projectile such that, in response to the projectile advancing movement of the first positioning member, the first retention member pushes the respective projectile along the chamber towards the projectile loading position.

4. The magazine according to claim 3, wherein the first retention member further comprises a sliding surface adapted to slidably engage its respective projectile during a retraction movement of the first positioning member, such that, in response to said retraction movement, the first retention member slides over a surface of its respective projectile without displacing said projectile along the chamber.

5. The magazine according to claim 3, wherein the plurality of first engaging means are arranged to align longitudinally at the first positioning member which extends at least partially along the chamber.

6. The magazine according to claim 1, wherein the one or more first engaging means are movably and/or flexibly connected at and/or to the first positioning member.

7. The magazine according to claim 1, wherein the first positioning member is slidably mounted in the housing.

8. The magazine according to claim 1, further comprising a second positioning member arranged at the chamber and being in a fixed position relative to the housing, the second positioning member comprising one or more second engaging means adapted to engage the one or more projectiles to thereby permit the one or more projectiles to move longitudinally along the chamber in one direction only in response to the projectile advancing movement of the first positioning member.

9. The magazine according to claim 8, wherein the one or more second engaging means are adapted to co-operate with the one or more first engaging means to permit movement of the one or more projectiles in only one direction.

10. A toy gun having the magazine for receiving and accommodating one or more projectiles according to claim 1, the toy gun comprising:

a loading handle mounted with the first positioning member and movable between a first position and a second position;

wherein the loading handle is operable such that, when the loading handle is moved from the first position to the second position, a first projectile at a first projectile position of the chamber is transferred to a predetermined position of the toy gun; and subsequently, when the loading handle is moved from the second position to the first position, one or more inline projectiles succeeding the first projectile are arranged to move longitudinally along the chamber in one direction only to thereby fill the first projectile position with a subsequent, second projectile.

11. The toy gun according to claim 10, further comprising a projectile transferring mechanism operatively connected with the loading handle for transferring the first projectile from the first projectile position to the predetermined position.

12. The toy gun according to claim 11, wherein the projectile transferring mechanism comprises an arm member adapted to engage the first projectile at the first projectile position, and subsequently, transfer and release the first projectile at the predetermined position of the toy gun, with the projectile transferring mechanism being actuatable by moving the loading handle from the first position to the second position.

13. The toy gun according to claim 10, further comprising a launching mechanism for launching a projectile located at the predetermined position of the toy gun, wherein the launching mechanism comprises a launching member engageable with the projectile at the predetermined position prior to launching of said projectile.

14. The toy gun according to claim 13, wherein the launching member is connected with the loading handle and is arranged to engage the projectile at the predetermined position in response to movement of the loading handle from the second position to the first position.

15. A method of manufacturing a toy gun part, comprising steps of:

providing a magazine for receiving and accommodating one or more projectiles according to claim 1;

arranging a loading handle to be mounted with the first positioning member of the magazine and to be movable between a first position and a second position;

wherein the loading handle is operable such that, when the loading handle is moved from the first position to the second position, a first projectile at a first projectile position of the chamber is arranged to be transferred to a predetermined position of the toy gun; and when the loading handle is moved from the second position to the first position, one or more inline projectiles succeeding the first projectile are arranged to move longitudinally along the chamber in one direction only to thereby fill the first projectile position with a subsequent, second projectile.

16. The method according to claim 15, wherein the steps of providing a magazine comprises the steps of:

providing the housing which defines the chamber adapted to accommodate the one or more projectiles in a longitudinal, inline arrangement;

arranging the first positioning member at the chamber, the first positioning member being movably arranged relative to the housing;

providing the first positioning member with one or more first engaging means adapted to engage the one or more projectiles, such that the one or more projectiles are permitted to move longitudinally along the chamber in one direction only in response to the projectile advancing movement of the first positioning member.

17. The method according to claim 16, further comprising the steps of fixedly arranging a second positioning member at the chamber, and providing the second positioning member with one or more second engaging means adapted to cooperate with the one or more first engaging means to thereby permit the one or more projectiles to move longitudinally along the chamber in one direction only.

18. The method according to claim 15, further comprising steps of:

providing a barrel having a muzzle for the toy gun, the barrel defining the predetermined position at or adjacent the muzzle; and providing a mechanism for transferring the first projectile from the first projectile position at the chamber to the predetermined position at the barrel.

19. The method according to claim 18, wherein the projectile transferring mechanism is actuatable by moving the loading handle from the first position to the second position.

20. The method according to claim 15, further comprising a step of providing a mechanism for launching the projectile from the predetermined position, wherein the launching mechanism comprises a launching member adapted to engage the projectile at the predetermined position prior to launching of said projectile, the launching member being movable in response to movement of the loading handle from the second position to the first position.

* * * * *